US005158514A

United States Patent [19]

Braga

[11] Patent Number: 5,158,514

[45] Date of Patent: Oct. 27, 1992

[54] SILENT HERMETIC MOTOR-COMPRESSOR SET

[75] Inventor: Jean-Pierre Braga, Frontonas, France

[73] Assignee: L'Unite Hermetique, La Verpilliere, France

[21] Appl. No.: 617,201

[22] Filed: Nov. 23, 1990

[30] Foreign Application Priority Data

Dec. 1, 1989 [FR] France ..... 89 15880

[51] Int. Cl.[5] ..... F04B 17/00

[52] U.S. Cl. ..... 417/902

[58] Field of Search ..... 417/902, 310; 285/915, 285/192; 403/194, 195, 197, 238, 265, 267

[56] References Cited

U.S. PATENT DOCUMENTS

| | | | |
|---|---|---|---|
| 3,902,629 | 9/1975 | Kushner | 417/902 |
| 4,240,774 | 12/1980 | Ladusaw | 417/902 |
| 4,573,880 | 3/1986 | Hirano et al. | 417/902 |
| 4,675,937 | 6/1987 | Mitomi | 403/194 |
| 4,815,947 | 3/1989 | Okoma et al. | 417/410 |
| 4,958,990 | 9/1990 | Gordon et al. | 417/902 |
| 4,984,973 | 1/1991 | Itameri-Kinter et al. | 417/902 |

FOREIGN PATENT DOCUMENTS

| | | |
|---|---|---|
| 1045429 | 12/1958 | Fed. Rep. of Germany . |
| 2382597 | 9/1978 | France . |
| 1229408 | 4/1971 | United Kingdom . |

*Primary Examiner*—Richard A. Bertsch
*Assistant Examiner*—Alfred Basichas
*Attorney, Agent, or Firm*—Oblon, Spivak, McClelland, Maier & Neustadt

[57] ABSTRACT

Hermetic motor-compressor set with a metal shell formed by hermetic assembly of metal component parts, characterized by the fact that the metal shell is equipped, in the joint of its assembled metal component parts, with a hermetic assembly bead of a nature different from that of these component parts and contributing to form a solid hermetic composite shell.

5 Claims, 1 Drawing Sheet

SILENT HERMETIC MOTOR-COMPRESSOR SET

BACKGROUND OF THE INVENTION

The present invention concerns a silent hermetic motor-compressor set.

A hermetic motor-compressor set usually comprises a hermetic metal shell formed of a basin and a cover, in which are mounted a compressor set and its driving motor. The hermetic motor-compressor sets sold on the market generally have a sheet steel shell which is hermetically welded. The steel basin and cover which form their shell are thus rigidly held together mechanically by a steel welding bead of the same nature as the basin and cover. This welding bead contributes to form a single-block shell presenting a continuity of physical characteristics or properties in all its parts.

When these hermetic motor-compressor sets are in operation, their compressor set and driving motor generate acoustic radiation and mechanical vibrations which excite the welded metal shell, which in its turn begins to vibrate and radiates annoying acoustic energy to the exterior. The hermetic motor-compressor sets with welded shells on the market are thus noisy during operation.

SUMMARY OF THE INVENTION

The present invention, whose object is to eliminate these disadvantages, enables a hermetic motor-compressor set with a metal shell to be made which will operate with an admissible minimum of noise, otherwise known as silent operation.

According to the invention, a hermetic motor-compressor set with a metal shell formed by hermetic assembly of metal component parts is characterized by the fact that the metal shell is equipped, in the joint between its assembled metal component parts, with a hermetic assembly bead of a different nature from that of these component parts and contributing to form a solid hermetic composite shell.

BRIEF DESCRIPTION OF THE DRAWINGS

In order for the invention to be better understood, a number of examples of embodiment are described below with reference to the appended drawings, of which.

DESCRIPTION OF THE PREFERRED EMBODIMENTS

Figure 1:
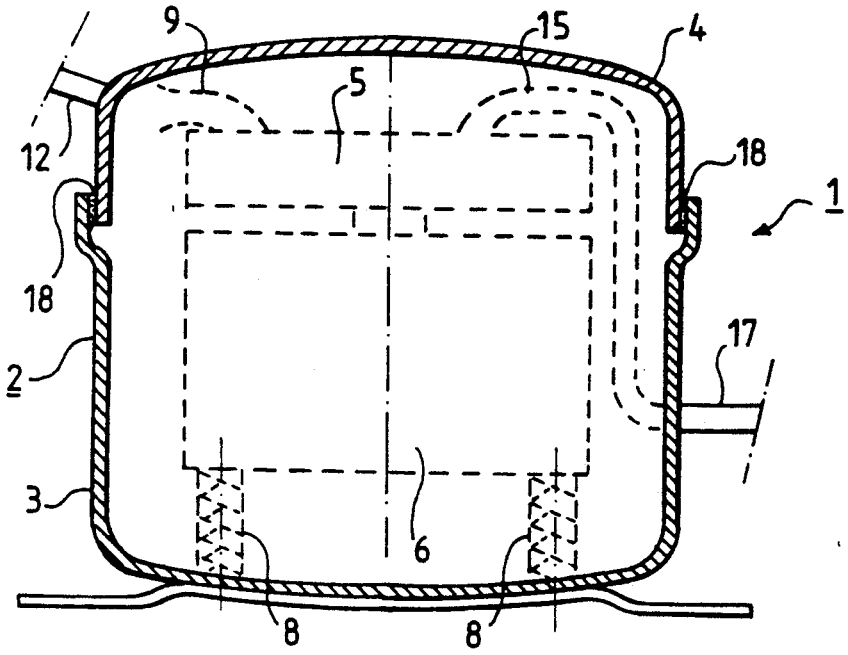
FIG. 1 represents a partial simplified view, in vertical section, of a hermetic motor-compressor set according to the invention showing a shell assembled by bonding.

A hermetic motor-compressor set 1 according to one example of embodiment of the invention, illustrated in FIG. 1, comprises on the outside a metal shell 2 formed of a hermetic assembly of a basin 3 and a cover 4, and on the inside a compressor 5 and an electric driving motor 6. The unit formed by the compressor 5 and motor 6 is suspended inside the shell 2 using elastic legs or springs 8. An inlet pipe 9 for admission of a gaseous refrigerant fluid mounted at one entry into the compressor 5 opens inside the hermetic shell 2 in the neighborhood of a pipe 12 for return of the refrigerant fluid into the hermetic motor-compressor set 1. A delivery pipe 15 for the compressed refrigerant fluid connects an exit from this compressor 5 to an external refrigerant circuit 17, through a wall of the hermetic shell 2.

When the hermetic motor-compressor set is in operation, the compressor 5 and the driving motor 6 generate acoustic radiation and mechanical vibrations inside the metal shell 2 which tend to excite this shell 2 and make it begin to vibrate in its turn.

According to the invention, to impede or prevent the vibration of the shell 2 under the stimulus of an acoustic radiation and the mechanical vibrations emitted by the compressor 5 and the driving motor 6, the hermetic motor-compressor set 1 comprises a metal shell 2 constituted of metal component parts and equipped, in the joint between these assembled component parts, with a hermetic assembly bead of a nature different from that of these component parts which contributes to form not a single-block shell presenting a relative continuity of physical characteristics or properties, but a solid hermetic composite shell presenting a discontinuity of physical characteristics or properties at the joint of its component parts.

The hermetic assembly bead of the metal component parts of the shell 2 is preferably constituted of a non-metallic material.

In an example of embodiment illustrated in FIG. 1, the hermetic motor-compressor set 1 comprises a hermetic metal shell 2 formed of metal component parts, which are a basin 3 and a cover 4 of sheet steel, and equipped in the assembly joint of these metal component parts with a hermetic assembly bead constituted by a layer of an adhesive 18.

The hermetic assembly bead of the component parts of the hermetic shell 2 is resistant to the action of the refrigerant fluid and the lubricant used in the hermetic motor-compressor set 1, and ensures good sealing of the shell 2 and good mechanical liaison for the assembly of these metal component parts. The result obtained is such that the product resists the temperatures reached during the stages of manufacture without damage. The lifetime of the compressor obtained is at least equivalent to that of a compressor assembled using a welding bead.

The adhesive 18 which constitutes a hermetic assembly bead for the component parts of the shell 2 is an adhesive of natural or synthetic origin sold on the market.

In the example illustrated in FIG. 1, the delivery pipe 15 of the compressed refrigerant fluid which connects an exit from the compressor 5 to the external refrigerant circuit 17 is hermetically welded to the wall of the metal shell 2 where it crosses this wall.

Figure 2:
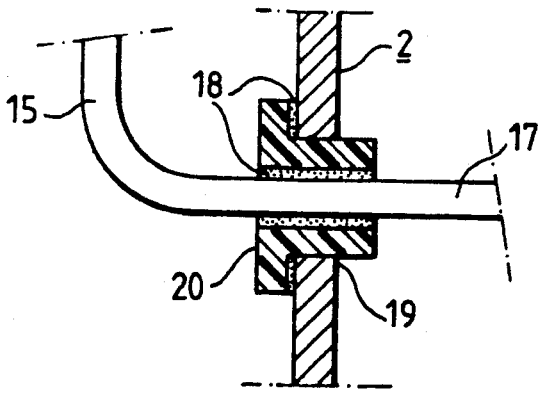
FIG. 2 represents a partial vertical section view of a variant embodiment of the motor-compressor set in FIG. 1, showing a section of a delivery hose for the compressed refrigerant fluid, where it crosses a wall of the shell of this motor-compressor set.

In a variant embodiment of the motor-compressor set 1, partially illustrated in FIG. 2, the delivery pipe 15 of the compressed refrigerant fluid is mounted hermetically through a hole 19 in the wall of the metal shell 2, via a sleeve tube of elastic material 20, solidly and hermetically retained on the pipe 15 and this wall of the shell 2 by a layer of an adhesive similar or identical to the adhesive 18. The sleeve tube 20 is constituted of an elastic material resistant to the refrigerant fluid and to the lubricant.

When the motor-compressor set 1 is in operation, thanks to an assembly bead made according to the invention and intended to maintain the basin 3 and the cover 4 hermetically assembled, the shell 2, excited by the acoustic radiation and the mechanical vibrations from the compressor 5 and the driving motor 6, resists this stimulation effectively, brakes its entry into vibration and does not emit annoying acoustic radiation.

What is claimed is:

1. A hermetic motor-compressor set including a shell formed by hermetic assembly of metal component parts, wherein said shell comprises:

means for effectively breaking transmission of mechanical vibrations from at least a first metal component part to at least a second metal component part adjacent said first metal component part, said means for breaking transmission of mechanical vibration interposed between said first and second metal component parts at a joint between said first and second metal component parts, wherein a composite shell of the hermetic motor-compressor set includes said first and second metal component parts and said means for breaking transmission of mechanical vibrations, said means for breaking transmission being different in nature from the metal component parts so as to introduce a discontinuity of physical properties in the structure of the composite shell at the joint in terms of the transmission of mechanical vibrations to thereby break the transmission of mechanical vibrations.

2. The hermetic motor-compressor set of claim 1, wherein said means for breaking transmission of mechanical vibrations includes a bead of an adhesive.

3. The motor-compressor set of claim 1, wherein one of said first and second metal component parts is a basin, and the other of said first and second metal component parts is a cover, each formed of sheet steel, and wherein the means for breaking a transmission of mechanical vibrations is formed of a material which is resistant to the action of refrigerant fluids and lubricants used in the motor-compressor set, thereby ensuring sealing of the shell and a good mechanical interface for the assembly of metal component parts.

4. The motor-compressor set of claim 2, wherein the adhesive comprises one of a natural adhesive and a synthetic adhesive.

5. The motor-compressor set of claim 1, further including a delivery pipe for providing compressed refrigerant fluid to the motor-compressor set, said delivery pipe hermetically mounted and associated with a hole provided in a wall of the shell utilizing a sleeve tube formed of an elastic material which is firmly and hermetically maintained upon the pipe in the wall of the shell by a layer of an adhesive.

* * * * *